United States Patent [19]

Haw

[11] 3,975,915

[45] Aug. 24, 1976

[54] ANCHOR ASSEMBLY FOR AN INFLATABLE FABRIC DAM

[75] Inventor: Sherwood Gordon Haw, Magnolia, Ark.

[73] Assignee: The Firestone Tire & Rubber Company, Akron, Ohio

[22] Filed: Oct. 23, 1974

[21] Appl. No.: 517,269

[52] U.S. Cl. ..... 61/30; 52/2

[51] Int. Cl.[2] ..... E02B 7/02

[58] Field of Search ..... 61/30, 27; 52/2, 3, 52/222, 273; 24/263 A, 263 SL, 243 B, 243 K, 243 N, 243 M, 243 FS, 265 BC

[56] References Cited

UNITED STATES PATENTS

| | | | |
|---|---|---|---|
| 1,202,475 | 10/1916 | Brent | 24/243 K |
| 1,779,053 | 10/1930 | Stoner | 24/263 A |
| 1,964,818 | 8/1934 | Hood | 52/2 |
| 2,506,010 | 5/1950 | Birkenmaier | 24/263 A X |
| 2,699,190 | 1/1955 | Packer | 24/263 A |
| 2,798,502 | 7/1957 | D'Azzo | 135/5 |
| 2,914,776 | 12/1959 | Hotz | 52/2 X |
| 3,067,712 | 12/1962 | Doerpinghaus | 61/5 X |
| 3,199,258 | 8/1965 | Jentoft et al. | 52/222 |
| 3,246,474 | 4/1966 | Mesnager | 61/30 |
| 3,355,851 | 12/1967 | Imbertson et al. | 61/30 |
| 3,496,686 | 2/1970 | Bird | 52/2 |
| 3,719,341 | 3/1973 | Harrington | 52/2 X |

*Primary Examiner*—Dennis L. Taylor

[57] ABSTRACT

An assembly to anchor an inflatable fabric dam on a foundation. The assembly includes an elongate base plate, a buttress means, and a bridge plate supported on the buttress means and extending longitudinally above the base plate. A flange along one edge of the bridge plate provides a longitudinal throat opening into a rectangular anchor cavity. The anchor cavity is formed when the bridge plate is secured above the base plate. When the dam is inflated, the fabric of the dam extending through the throat is clamped against a portion of the anchor cavity by a rectangular anchor means captive within the cavity.

6 Claims, 4 Drawing Figures

ANCHOR ASSEMBLY FOR AN INFLATABLE FABRIC DAM

BACKGROUND OF THE INVENTION

The invention relates to an assembly to anchor an inflatable fabric dam on a foundation.

An inflatable fabric dam, also referred to as a collapsible dam or a flexible, vertically adjustable dam, is disclosed, for example, in U.S. Pat. No. 3,173,269, March 1965, Imbertson, and U.S. Pat. No. 3,246,474, April 1966, Mesnager.

Anchor assemblies of interest are disclosed, for example, in U.S. Pat. No. 3,355,851, December 1967, Imbertson et al; U.S. Pat. No. 2,914,776, December 1959, Hotz; or U.S. Pat. No. 2,798,502, July 1957, D'Azzo.

The assembly disclosed in U.S. Pat. No. 3,355,851, December 1967, Imbertson et al is a securing apparatus intended to exert a strong downward force on the thin fabric forming the dam; the components require precision fabrication and are therefore relatively expensive; and components are difficult to install under field conditions, requiring a floor or seal sheet extending into the anchor.

SUMMARY OF THE INVENTION

The object of the invention is to provide an improved assembly to anchor an inflatable fabric dam on a foundation.

It is further object of the invention to provide an improved assembly which exerts a uniform tension on the thin fabric forming the dam, which uses readily available and inexpensive components, which is simple to install and which does not require a floor or seal sheet extending into the anchor.

These and other objects of the invention, and the advantages thereof, will be apparent in view of the detailed description of embodiments thereof as set forth below.

In general, an assembly to anchor an inflatable fabric dam on a foundation, according to the invention, includes an elongate base plate adapted for support on or to traverse the foundation. Buttress means project upwardly of the base plate. A bridge plate supported on the buttress means extends longitudinally above the base plate. A flange projects downwardly along one edge of the bridge plate and terminates a predetermined distance above the base plate to provide a longitudinal throat opening into a rectangular anchor cavity. The anchor cavity has a vertical outer wall defined by the flange, a horizontal lower wall defined by the base plate, and a horizontal upper wall defined by the bridge plate. The anchor cavity is formed when the bridge plate is secured above the base plate. In all embodiments of the invention, an anchor means captive within the anchor cavity clamps or "pinches" a portion of the fabric of the dam which extends through the throat and around the anchor means, against a portion of the anchor cavity when the fabric dam is inflated.

DETAILED DESCRIPTION OF THE INVENTION

Figure 1:
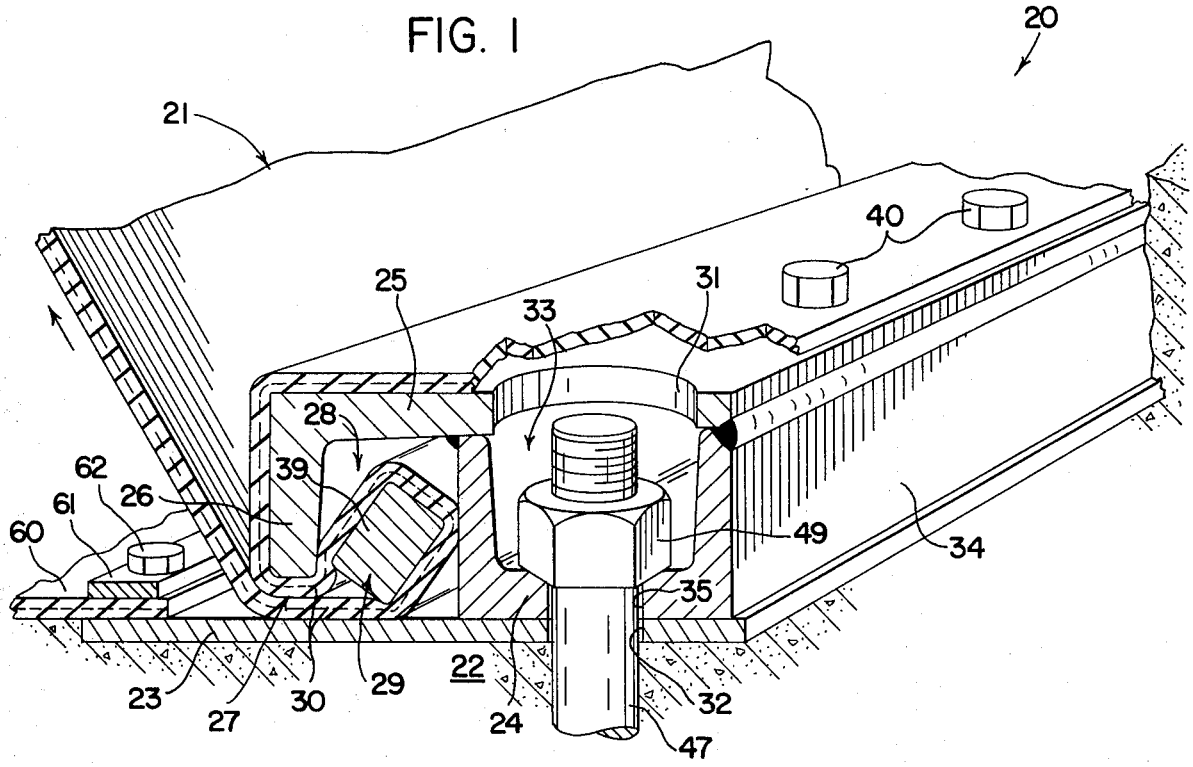
FIG. 1 is a perspective view of an embodiment of an anchor assembly, according to the invention, with the dam in an inflated condition.

Referring to the drawings, an anchor assembly according to the invention is indicated generally by the numeral 20, which is used to secure the end portion of an inflatable fabric dam 21 on a foundation 22. The foundation 22 is generally placed across the bed (not shown) of an irrigation canal or stream. The dam 21 is inflated to the degree necessary to control the flow of water in the canal or stream as required.

The assembly 20 has a major component oriented across the stream in the form of an elongate base plate 23, supported on the foundation 22. The base 23 supports the buttress means 24. The buttress means 24 is vertically oriented and extends longitudinally of the base plate 23. The buttress means 24 supports a bridge plate 25 extending longitudinally above the base plate 23.

Along one edge of the bridge plate 25 is a downwardly directed flange 26 terminating a predetermined distance above the base plate 23 to provide a throat 27. The throat 27 extends longitudinally above the base plate 23 and beneath the bridge plate 25, and opens into a rectangular anchor cavity 28.

An anchor means 29 is captive within the anchor cavity 28 adjacent the throat 27. The anchor means 29 functions to clampingly engage the fabric of the dam 21, upon inflation thereof, when a portion 30 thereof extends into the anchor cavity 28 through the throat 27, envelopes the anchor means 29 and again exits from the anchor cavity 28 through the throat 27.

The bridge plate 25 and the base plate 23 have openings therethrough indicated by the respective numerals 31 and 32. Each set of coaxially aligned openings 31 and 32 receives a fastening means 33, to secure the assembly 20 to the foundation 22.

With reference to FIG. 1, an assembly 20 according to one embodiment of the invention is shown, whereby one end of an inflatable fabric dam 21, for example the upstream end, is anchored on a foundation 22. Preferably, an oppositely oriented but otherwise similar assembly 20 is used to anchor the opposite, or downstream, end.

Referring still to FIG. 1, an elongated base plate 23 is a primary component of an assembly 20 and is adapted for support on a foundation 22, conforming to the contours thereof. As shown, the base plate 23 may be embedded in a concrete foundation 22. The end of a seal sheet 60 is fastened, as by a bar 61 and a bolt means 62, to the base plate 23.

Figure 2:
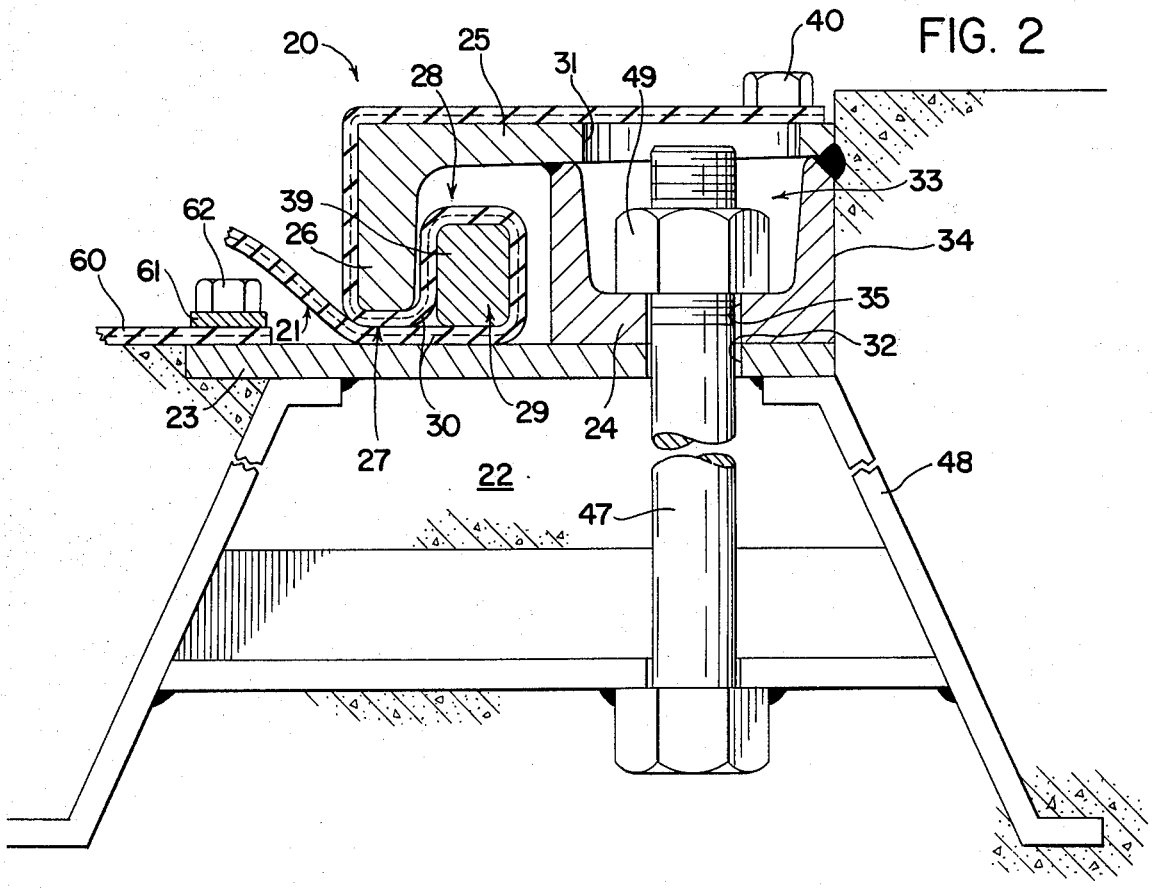
FIG. 2 is a side view of the anchor assembly of FIG. 1 with the dam in a deflated condition.

The base plate 23 supports a buttress means 24. The buttress means 24 is vertically oriented and extends longitudinally on the base plate 23. As shown in FIGS. 1 and 2, the buttress means 24 may be a C-shaped beam 34 secured to the base plate 23, as by a fastening means 33 inserted through an opening 35 in the buttress means 24.

Figure 3:
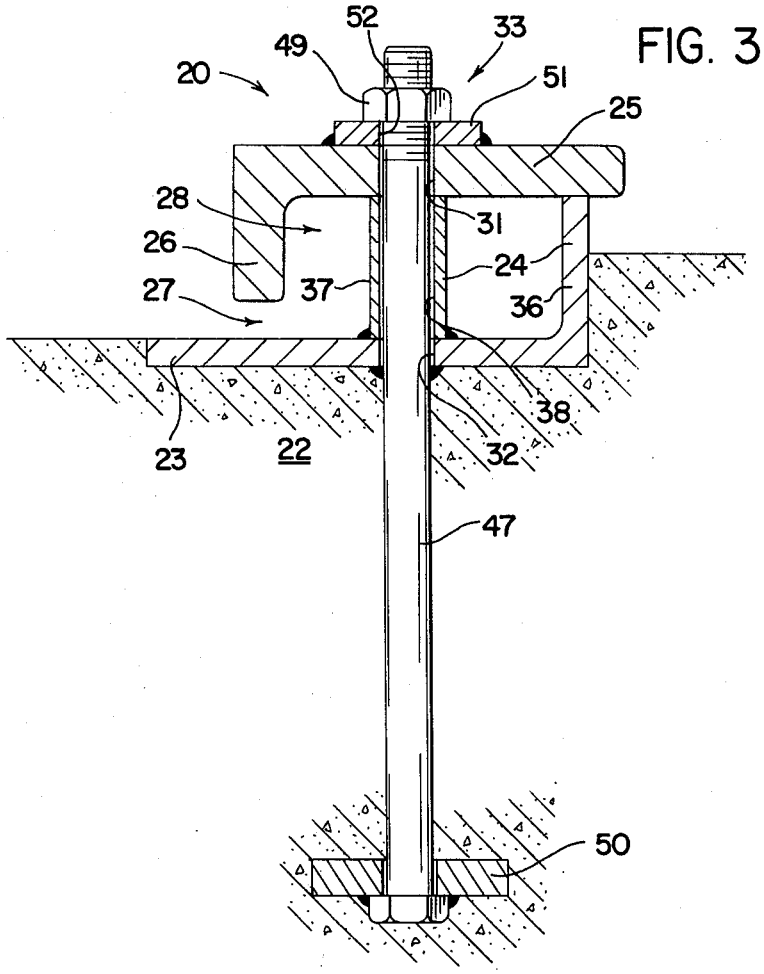
FIG. 3 is a side view showing components of another anchor assembly according to the invention; and, FIG. 4 is a side view showing components of an anchor assembly according to the invention.

As shown in FIG. 3, the buttress means 24 may comprise a flange 36, which may be integral with the base plate 23, and a vertically oriented medial member 37. The member 37 is secured to the base plate 23, as by welding, and comprises a rectangular bar with an opening 38 therein for receiving a fastening means 33 therethrough.

Figure 4:
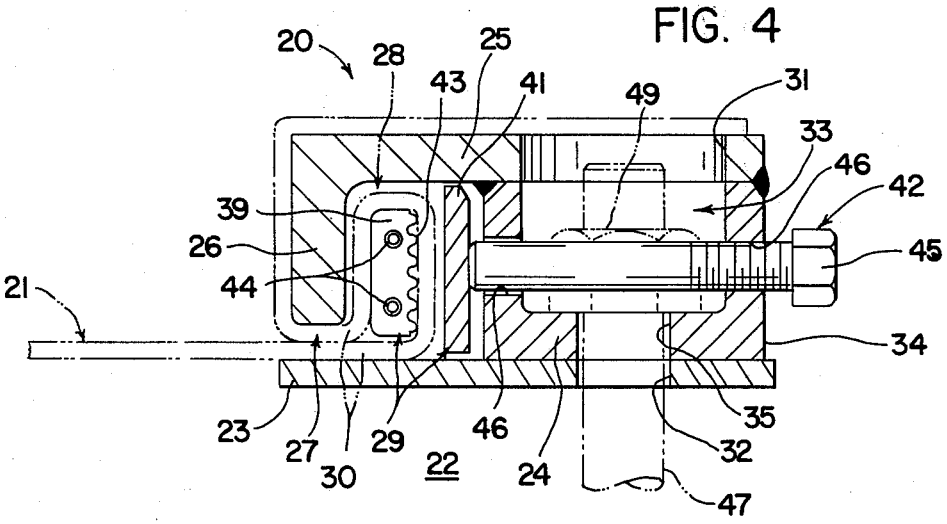

The buttress means 24 supports a bridge plate 25, extending longitudinally above the base plate 23. As shown in Figs. 1, 2 and 4, the bridge plate 25 may be secured to the buttress means 24, as by welding. Alternatively, the bridge plate 25 may be positioned on the buttress means 24 by a fastening means 33, as shown in FIG. 3, and by additional fasteners (not shown) intermediate the fastening means 33 and extending down into, but not through the member 37.

A flange 26 terminates a predetermined distance above the base plate 23 to provide a throat 27. In addition to providing a throat 27, the location of the flange 26 spaced from the buttress means 24 defines the vertical outer wall of the anchor cavity 28. The horizontal upper wall of the anchor cavity 28 is defined by the bridge plate 25 and the horizontal lower wall by the base plate 23. As shown in FIGS. 1, 2 and 3, the vertical inner wall of the anchor cavity 28 is defined by the buttress means 24.

Referring to FIGS. 1 and 2, the anchor means 29 takes the form of an elongated rectangular bar 39 captive within the anchor cavity 28. The end portion of the fabric dam 21 exiting from the cavity 28 may be fastened to the upper surface of the bridge plate 25, as by cap screws 40.

Referring to FIG. 4, the anchor means 29 comprises an anchor bar 39 and a clamp bar 41 actuated by a clamp bar actuating means 42.

The anchor bar 39 is shown captive within the anchor cavity 28. Although shown to be rectangular in cross-section, the bar may usefully be a parallelogram in section. The vertical inner wall of the anchor cavity 28 in this embodiment is defined by the clamp bar 41 positioned between the buttress means 24 and the anchor bar 39. The anchor bar 39 may be as shown in FIGS. 1 and 2 or, as shown in FIG. 4, may have a serrated or corrugated fabric-engaging face 43. Further, the anchor bar 39 may comprise a series of segments connected and reinforced by one or more elongate rods 44 therethrough, and whose fabric-engaging faces 43 may be staggered.

The size of the anchor cavity 28 of FIG. 4 may be varied by the clamp bar actuating means 42, such as a bolt 45 inserted through an opening 46 in the buttress means 24. This variation in the size of the anchor cavity 28 enables a single anchor assembly 20 to accommodate anchor bars 39 of various dimensions as well as fabric portions 30 of various thicknesses.

FIGS. 2 and 3 show different fastening means 33 to provide for reinforced securement of the assembly 20 to the foundation 22.

In FIG. 2, the anchor bolt 47 and the base plate 23 are secured, as by welding, to an A-frame structure 48 and embedded in a concrete foundation 22. The dam 21 is secured to the foundation 22 by a fastening nut 49 on the anchor bolt 47.

In FIG. 3, the anchor bolt 47 is secured, as by welding, to a plate 50 and to the base plate 23 and embedded in a concrete foundation 22. The anchor bolt 47 extends through the buttress means 24 and the bridge plate 25, to which is secured, as by welding, a reinforced plate 51 with an opening 52 therethrough. The dam 21 is secured to the foundation 22 by a fastening nut 49 on the anchor bolt 47.

The clamping action of the anchor means 29 can best be understood with reference to FIGS. 1 and 2. FIG. 2 represents the position of the anchor bar 39 prior to tensioning of the fabric through inflation of the dam 21.

As shown in FIG. 1, tension on the fabric in the direction of the arrow, developed by inflation of the dam 21, causes the anchor bar 39 to rotate within the anchor cavity 28 and to clampingly engage areas of the portion 30 against at least three walls of the anchor cavity 28: the vertical outer wall, the horizontal lower wall and the vertical inner wall.

The anchor bar 39 must be of such size that its shortest dimension is substantially greater than the throat 27, so that the anchor bar 39 will not enter into the throat 27.

The wedging action of the anchor bar 39 against the walls of the anchor cavity 28 distributes the tension load uniformly along the length of the flange 26, while minimizing the tendency of the flange 26 to lift and thus widen the throat 27. Thus, the dam 21 is sealed tightly against the base plate 23, the buttress means 24 and the flange 26. No load is placed on the cap screws 40, and the need for a seal sheet extending into the anchor assembly 20 is eliminated.

The rotational clamping action further eliminates the need for compressing the fabric portion 30 in the throat 27 prior to inflation of the dam 21. The throat 27 may therefore be made wide enough to accommodate, without difficulty, various thicknesses of the fabric portion 30 passing therethrough, allowing for positive seating of the bridge plate 25 relative to the base plate 23, and eliminating any rocking effect.

Referring again to FIG. 4, the anchor means 29 of this embodiment may function in one of two manners. The clamp bar 41 may be actuated to push the anchor bar 39 toward the flange 26, clampingly engaging the portion 30 between two walls of the anchor cavity 28: the vertical outer wall, defined by the flange 26, and the vertical inner wall, defined by the clamp bar 41. If the clamp bar 41 is forced tightly against the portion 30 so as to prevent rotation, or to permit only slight rotation, of the anchor bar 39 upon inflation of the dam 21, the tension load will be distributed uniformly along the flange 26 as described above, but the dam 21 will be sealed tightly only against the flange 26.

Alternatively, the clamp bar 41 may be used primarily to vary the size of the anchor cavity 28 so as to suitably accommodate the particular anchor bar 39 chosen for use, while allowing the anchor bar 39 to rotate within the anchor cavity 28 upon inflation of the dam 21, as described above with reference to FIGS. 1 and 2.

What is claimed is:

1. An assembly for anchoring an inflatable fabric dam on a foundation comprising:

a substantially horizontal base plate on the foundation, buttress means projecting upwardly of said base plate, a substantially horizontal bridge plate supported on said buttress means, a substantially vertical flange extending from said bridge plate and terminating a predetermined distance above said base plate and forming therewith a throat, said base plate, buttress, bridge plate and flange defining a four-sided, substantially rectangular anchor cavity, and anchor means of parallelogram cross-section and of a size to maintain it captive within said four-sided anchor cavity, said anchor means rotatable to clamp a portion of the fabric of the dam against a portion of said anchor cavity when the fabric extending through said throat and around said anchor means is tensioned.

2. An assembly according to claim 1 wherein said anchor means comprises a rectangular anchor bar.

3. An assembly according to claim 1 wherein said anchor means comprises a rectangular anchor bar and a clamp bar actuated to move between said anchor bar and said buttress means.

4. An assembly according to claim 3 wherein said clamp bar is actuated by an actuating means comprising a bolt inserted through said buttress means and engaging said clamp bar.

5. An assembly according to claim 3 wherein said rectangular anchor bar has a corrugated fabric-engaging face.

6. For anchoring an inflatable fabric dam on a foundation, an assembly comprising:

a substantially horizontal base plate on the foundation, buttress means projecting upwardly of said base plate, a substantially horizontal bridge plate supported on said buttress means, a substantially vertical flange extending from said bridge plate and terminating a predetermined distance above said base plate and forming therewith a throat, said base plate, buttress, bridge plate and flange defining a four-sided, substantially rectangular anchor cavity, and anchor means of parallelogram cross-section and having its shortest dimension substantially greater than said throat, said anchor means rotatable to clamp a portion of the fabric of the dam against a portion of said anchor cavity when the fabric extending through said throat and around said anchor means is tensioned.

* * * * *